US009526400B2

(12) United States Patent
Savoia

(10) Patent No.: US 9,526,400 B2
(45) Date of Patent: Dec. 27, 2016

(54) APPARATUS FOR ABATEMENT OF VAPORS FOR WASHING MACHINES AND WASHING MACHINE COMPRISING THE APPARATUS

(71) Applicant: IWT S.R.L., Casale Litta (IT)

(72) Inventor: Luciano Savoia, Saronno (IT)

(73) Assignee: IWT S.R.L., Casale Litta (IT)

( * ) Notice: Subject to any disclaimer, the term of this patent is extended or adjusted under 35 U.S.C. 154(b) by 113 days.

(21) Appl. No.: 14/537,539

(22) Filed: Nov. 10, 2014

(65) Prior Publication Data

US 2015/0128438 A1 May 14, 2015

(30) Foreign Application Priority Data

Nov. 11, 2013 (IT) ..... MI2013A1867

(51) Int. Cl.

| | |
|---|---|
| ***F26B 21/06*** | (2006.01) |
| ***A47L 19/00*** | (2006.01) |
| ***B08B 3/02*** | (2006.01) |
| ***B08B 15/02*** | (2006.01) |
| ***F28D 21/00*** | (2006.01) |
| ***F28D 1/02*** | (2006.01) |
| *F28D 15/02* | (2006.01) |

(52) U.S. Cl.

CPC ..... *A47L 19/00* (2013.01); *B08B 3/02* (2013.01); *B08B 15/02* (2013.01); *F28D 1/024* (2013.01); *F28D 21/0014* (2013.01); *F28D 15/02* (2013.01)

(58) Field of Classification Search

CPC ..... F26B 21/00; F26B 21/06; F26B 21/14; A47L 19/00; H01L 21/00; H01L 21/67034; B08B 3/00; B08B 3/02; B08B 3/024

USPC ..... 34/72, 77, 78, 82; 134/21, 25.1, 56 D, 134/95.3

See application file for complete search history.

(56) References Cited

U.S. PATENT DOCUMENTS

| | | | | |
|---|---|---|---|---|
| 4,841,645 A * | 6/1989 | Bettcher | H01L 21/67034 | 34/470 |
| 5,715,612 A * | 2/1998 | Schwenkler | F26B 21/145 | 34/470 |
| 6,026,588 A * | 2/2000 | Clark | F26B 21/145 | 34/77 |
| 6,108,932 A * | 8/2000 | Chai | H01L 21/67034 | 34/245 |
| 6,134,807 A * | 10/2000 | Komino | H01L 21/67034 | 34/418 |

(Continued)

FOREIGN PATENT DOCUMENTS

| | | | |
|---|---|---|---|
| DE | 738312 C | 8/1943 | |
| DE | EP 2497853 A1 * | 9/2012 | D06F 37/262 |

(Continued)

OTHER PUBLICATIONS

International Search Report for Italian Patent No. IT MI20131867, Jul. 29, 2014.

*Primary Examiner* — Stephen M Gravini
(74) *Attorney, Agent, or Firm* — LeClairRyan, a Professional Corporation

(57) ABSTRACT

The present invention relates to an apparatus for abatement of vapors for washing machines as well as to a washing machine comprising the apparatus. The apparatus for abatement of vapors according to the present invention simultaneously allows vapors generated inside the washing chamber to be effectively abated and the energy consumption of the machine to be optimized by pre-heating the working fluid.

15 Claims, 7 Drawing Sheets

(56) References Cited

U.S. PATENT DOCUMENTS

| | | | | |
|---|---|---|---|---|
| 6,802,137 | B1 * | 10/2004 | Gray | F26B 21/145 34/340 |
| 7,103,992 | B2 * | 9/2006 | Duden | A47L 15/4291 134/102.3 |
| RE40,123 | E * | 3/2008 | Johansen | A47L 15/48 34/595 |
| 7,621,285 | B2 * | 11/2009 | Robert | B08B 3/022 134/61 |
| 7,644,512 | B1 * | 1/2010 | Liu | C11D 11/0041 118/65 |
| 2004/0163427 | A1 * | 8/2004 | Oh | D06F 39/085 68/24 |
| 2010/0294323 | A1 | 11/2010 | Brunswick et al. | |
| 2015/0128438 | A1 * | 5/2015 | Savoia | B08B 3/02 34/72 |

FOREIGN PATENT DOCUMENTS

| | | | | | |
|---|---|---|---|---|---|
| EP | 2050381 | A2 | | 4/2009 | |
| GB | 1001328 | A | * | 8/1965 | B08B 3/02 |
| JP | 10057675 | A | * | 3/1998 | |
| JP | 2004-116868 | | * | 4/2004 | |
| KR | EP 0833003 | A1 | * | 4/1998 | D06F 17/06 |

* cited by examiner

APPARATUS FOR ABATEMENT OF VAPORS FOR WASHING MACHINES AND WASHING MACHINE COMPRISING THE APPARATUS

This application claims the benefit of Italian Patent Application Serial No. MI2013A001867 filed Nov. 11, 2013, which is hereby incorporated by reference in its entirety.

FIELD

The present invention relates to an apparatus for abatement of vapors, particularly for abating vapors generated inside the washing chambers of washing machines. More specifically, reference is made herein to a washing machine for washing tanks containing animals and/or other equipment or accessories used in stables and/or laboratories where scientific research is carried out.

BACKGROUND

As known, washing machines of the type comprising at least one washing chamber in which the devices, e.g. the animal containing tanks, to be subjected to treatment are positioned, are normally used for washing equipment used in research laboratories, in particular but not solely for washing the animal containing tanks used in stables.

The devices arranged inside the washing chamber and intended to be subjected to the treatment are generally indicated with the term "load".

In this washing chamber, there are wash water distribution means, said means typically comprising rods supporting a plurality of nozzles. Said rods generally support a plurality of nozzles for the distribution of wash water and a plurality of nozzles, different from the first ones, for the distribution of rinse water.

Again, according to a consolidated state of the art, the washing machines being referred to may be grouped into two different types, the type mainly depending on the machine dimensions.

Machines of smaller dimensions, and therefore having simpler architecture, advantageously comprise a water accumulation basin arranged close to the bottom of the washing chamber, adapted to collect the water distributed by the water distribution means, be it wash water or rinse water.

During the washing step, the water contained in the accumulation basin is recirculated by a pump towards the water distribution means in the washing chamber. Once distributed onto the load by means of the nozzles provided on the rods, the wash water falls into the accumulation basin provided at the bottom of the chamber.

The wash water is recirculated several times between the basin and the nozzles in order to optimize the amount of water used in this step. Since the load is dirty, the washing is also effective if the water in the accumulation basin becomes increasingly dirty at each recirculation.

When the load is to be rinsed, the rinse circuit of the machine takes the clean water directly from the mains and directs it to the nozzles in the washing chamber dedicated to rinsing, however not before having heated it to a temperature of about 82° C. by means of accumulation in a specific basin normally called "boiler", in which heating means are present (e.g. a common electric resistor).

The rinse water which is sprayed onto the load by means of the rinse circuit nozzles also falls back into the wash/rinse water accumulation basin, which is provided with an overflow which drains the water directly into the drainage system.

Therefore, the rinse water always contributes to renewing the washing bath because the addition of clean rinse water involves a renewal of the wash water, the washing being performed by recirculating the water which accumulates in the wash water accumulation basin.

Since the rinse water which mixes with the wash water in the accumulation basin alters the concentration of detergents normally provided in said washing bath, there are advantageously provided means for supplying detergent substances capable of restoring the proper concentration of detergents in the washing bath.

The type of machine just described thus provides for the wash water to perform a closed cycle during washing. For this reason, although the addition of clean mains water during the rinsing step partially dilutes the concentration of "dirt" in the bath contained in the washing basin, this water becomes increasingly dirty during the various washes, and for this reason the washing bath is to be replaced after a given number of wash cycles.

The second type of washing machine includes a water collection reservoir at the bottom of the washing chamber.

Therefore, the wash water is not collected in an accumulation basin arranged at the bottom of the washing chamber but there are instead two separate basins, one basin for the wash water and one basin for the rinse water, and the reservoir does not serve as an accumulation basin but only as a collection basin for the water which falls from the load when it is hit by the fluid sprayed by the nozzles.

Similarly to what occurs in the first type of machine described above, also in this case the wash water contained in the washing basin is sent onto the load through distribution means comprising rods and nozzles but, in this case, also due to the presence of a dedicated pump, because the sole pressure of the mains is not generally sufficient.

The wash water is then recirculated by means of a second pump arranged between the reservoir and the washing basin. Once the load has been hit, the wash water falls into the reservoir and from here is recirculated to the washing basin by means of said second pump.

A second basin contains the clean rinse water which originates from the mains. A dedicated pump pressurizes the rinse water which is sent to the rinse circuit nozzles. The rinse water is thus sprayed by means of the nozzles onto the load and falls back into the reservoir. The rinse water is directed from the collection reservoir back to the washing basin, which also in this case is provided with overflow. Therefore, also in this case the supply of clean rinse water in the washing basin contributes to diluting the dirt which accumulates in the washing basin.

The rinse water is heated to about 82° C. in the rinsing basin before being sent to the rinse nozzles.

In order to provide an idea of the dimensions of the washing machine of the second type described herein, it is sufficient to mention that the washing and rinsing basins have volumes of about 200 liters, respectively.

At the end of all wash cycles, the level of the rinsing basin needs to be restored by taking clean water from the mains, and the washing basin needs to be periodically completely emptied.

The washing process with both types of machines described includes adding acid- or alkaline-based detergents to the wash water bath, depending on the type of dirt to be removed, and in a first step it is brought to a temperature normally around 55° C. but which may also be higher, around 75-80° C., in order to thus increase the effectiveness and action of dissolving the substances deposited on the surfaces.

The rinsing step instead occurs at a higher temperature, generally at 82° C. but it may also be around 90° C.

During the washing and rinsing steps, water at a high temperature is therefore sprayed onto the load and thus the washing chamber of the machine fills up with vapors.

Furthermore, as mentioned, since the wash water generally contains detergent chemicals and the rinse water generally contains other chemicals adapted to neutralize the detergent products, the vapors may contain a given amount of chemicals which could be harmful if inhaled.

In order to avoid overpressure phenomena during the entire wash cycle, and especially in order to allow the door of the washing machine to be opened at the end of the cycle while avoiding the operator from being hit by the vapors, the state of the art provides installing, in the upper part of the washing chamber, a centrifuge fan for the extraction of vapors.

As known from the state of the art, the problem of abating the vapors formed in the washing chamber is currently resolved by providing the simple extraction of the vapors which are conveyed to the external environment or to a centralized extraction conduit. In both cases, dispersing the vapors without recovering the heat energy there from in any manner involves significant energy waste, not to mention the fact that the positioning of washing machines inside a laboratory or in the work environment is often generally not such as to allow the machine to be connected in a simple and affordable manner to the ventilation conduits of the building.

Certain solutions of known type include, generally on the larger machines, i.e. according to the second type of machines described herein, recovering heat energy from the vapors by abating the temperature thereof by condensing them by means of a cooling unit onboard the machine.

The operation of a cooling unit is well known, therefore it is not necessary to further describe the operation of this type of machines known from the state of the art, while it is sufficient to describe herein how the vapors generated inside the washing chamber are conveyed to the evaporator of said cooling circuit, the evaporation of the cooling fluid which crosses the cooling circuit in a closed cycle thus causing the condensing of the vapors generated inside the washing chamber.

The cooling cycle provides for the cooling fluid to condense again in a condenser. In the washing machines provided with cooling unit for abatement of vapors, the condenser in which the cooling fluid condenses by yielding heat to the fluid with which the heat exchange occurs is positioned inside the containing basin of the washing bath.

Thereby, the heat yielded from the condensing cooling fluid heats the washing bath thus finally recovering heat energy for heating the washing bath: the heat yielded from the condenser to the bath contributes to maintaining the operating temperature, thus saving energy which would otherwise be supplied by the heating systems (generally electric resistors, vapor/water exchangers and the like) provided on the machine.

However, these known solutions involve certain drawbacks.

Among the main drawbacks are those associated with the positioning of the coil which forms the cooling circuit condenser immerged in the washing bath. It has indeed been mentioned that detergent chemicals are added to the washing bath which are very aggressive and thus corrosive for the material forming the coil.

Another drawback which affects the known systems consists in that if the cooling unit condenser is inside the washing basin, e.g. in the form of coil, it will necessarily require being separated from the other components of the cooling unit, and this involves significant drawbacks during the installation step at the premises of the final user because machines are shipped with the basins disassembled to allow them to pass through smaller building openings: the technician installing the cooling unit is indeed a specialized technician, because the cooling liquid is pressurized inside the cooling circuit. Loading and pressurizing the cooling circuit are delicate operations which require specialized personnel with specific expertise in cooling systems, therefore having the condenser component inside the machine necessarily involves the intervention of a specialized technician also in the steps of installing/maintaining the machine at the premises of the final customer, which results in increasing costs and in any case is inconvenient.

In machines of known type, the positioning of the condenser inside the washing bath is mandatory, because it is not possible to imagine using the rinse water to perform the heat exchange with the cooling fluid. This is mainly due to the fact that, as mentioned, the water in the rinsing basin reaches 80-90° C., and therefore the temperature is too high to allow the cooling of the cooling fluid, and the heat exchange is therefore not possible.

Similarly, the clean water from the mains could be preheated with the cooling unit condenser, before the water reaches the rinse water accumulation basin, thus improving the energy efficiency of the machine. However, this is not possible because, as mentioned above, the level of clean water in the rinsing basin is only periodically restored by means of mains water, while the heat exchange in the cooling circuit condenser needs to occur continuously.

SUMMARY

For these reasons, there is no alternative to positioning the condenser currently used in known machines of larger dimensions provided with a cooling unit, and therefore there is no solution to the technical problems involved, while there is currently no effective solution for the abatement of vapors and the energy recovery in machines of smaller dimensions not provided with a cooling unit.

It is the main task of the present invention to resolve such technical problems by suggesting a vapor abatement apparatus for abating the vapors generated in the washing chamber of a washing machine, in particular of a discontinuous washing machine, while simultaneously recovering heat energy.

Within the scope of this task, it is the object of the present invention to provide an apparatus for abatement of vapors suitable to be installed both on washing machines provided with a cooling unit, and on washing machines without a cooling unit, i.e. of smaller dimensions.

It is also the object of the present invention to provide an apparatus for abatement of vapors which allows abating the amount of vapors present in the washing chamber at the end of a wash cycle while recovering the heat energy from the vapors, thus reducing the overall energy consumption of the machine.

Not lastly, it is the object of the present invention to provide a washing machine comprising said apparatus for abatement of vapors.

This task and these and other objects, which will become more apparent upon a detailed description of the present invention given herein by way for non-limiting illustrative purposes, are achieved by an apparatus for abatement of vapors for a washing machine of the type comprising at least one washing chamber, to which vapor aspiration means are connected, and further comprising washing means and rinsing means, which is characterized in that it comprises a hydraulic circuit in turn comprising heat exchange means configured to transfer heat from said vapors to said working fluid, and an outflow line adapted to discharge said working fluid to said rinsing means, said hydraulic circuit being adapted to recirculate a working fluid between said heat exchange means and said outflow line.

The apparatus according to the present invention is further characterized in that the hydraulic circuit further comprises means for accumulating said working fluid.

Further features will be derived from the appended claims, which form an integral part of the present description.

BRIEF DESCRIPTION OF THE DRAWINGS

Further features and advantages of the present invention will become more apparent from the following detailed description, provided by way of non-limiting example and shown in the accompanying drawings, in which.

DETAILED DESCRIPTION

Figure 1:
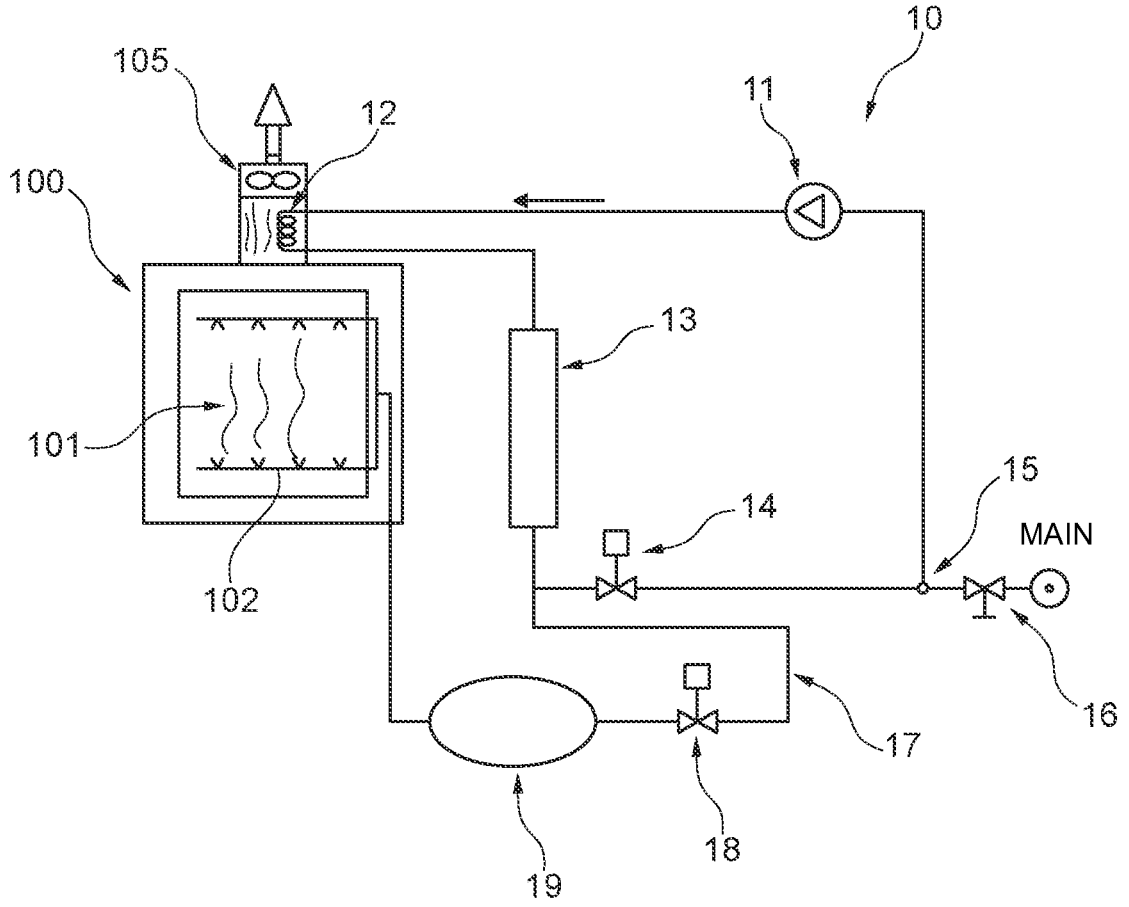
FIG. 1 shows a diagram of the apparatus for abatement of vapors according to the present invention, applied to a first type of washing machine.

With particular reference to FIG. 1, the apparatus for abatement of vapors according to the present invention is shown, applied to a washing machine 100 provided with a washing chamber 101 in which the load to be washed is arranged.

The washing means, for this first type of washing machine generally consisting of a washing circuit associated with dedicated nozzles arranged inside the washing chamber and with an accumulation basin of the washing bath arranged below the washing chamber, are not depicted in the diagram in FIG. 1. In the diagram instead, reference numeral 102 shows the rods and nozzles forming part of the rinsing means, which are adapted to spray the rinse water onto the load.

The apparatus for abatement of vapors according to the present invention comprises a hydraulic circuit 10 which in turn comprises heat exchange means 12 configured to transfer heat to the fluid which crosses said hydraulic circuit 10, moving means 11 of the fluid adapted to move the fluid inside the hydraulic circuit 10, at least one connection point 15 to the water mains for letting mains water into said hydraulic circuit 10.

To control the access of the mains water, a mains water on-off valve 16 is further provided upstream of said connection point 15. Valve 16 is generally a normally open manual valve which intercepts the mains water line to allow system maintenance to be performed. Such a valve never automatically intervenes and does not contribute in any manner to the operation of the cycle. When maintenance operations are to be performed on the system, the operator manually intervenes on the valve by closing it. By keeping circuit 10 normally connected to the mains and with the on-off valve 16 open, the hydraulic circuit 10 is always pressurized by the mains water.

Also present on said hydraulic circuit are accumulation means 13 of the fluid which crosses the circuit, first on-off means of the fluid 14 being provided downstream, with respect to the advancing direction of the fluid inside the circuit, of said accumulation means 13.

An outflow line 17 is further provided in order to discharge the fluid which crosses said circuit 10 to the rinsing means of the machine.

In this first machine configuration, the rinsing means comprise a basin 19 provided with heating means commonly called "boiler" connected to the rinsing rods and to the nozzles 102. The contribution of fluid to boiler 19 is regulated by the third on-off means 18 of the fluid.

As mentioned, hot vapors are generated inside the washing chamber 101 during the operation of the washing machine 100.

Arranged above the washing chamber are fume extraction means 105 which advantageously comprise an axial fan capable of extracting the vapors from the washing chamber 101.

The heat exchange means 12 configured to transfer heat to the fluid which crosses said hydraulic circuit 10 comprise, in this embodiment, an air/water heat exchanger. In greater detail, according to the diagram in FIG. 1, the fume extraction means 105 are associated with an air/water exchanger where the air side is pervaded by hot vapors originating from the washing chamber and the waterside forms part of the hydraulic circuit 10 of the apparatus for abatement of vapors.

The moving means 11 advantageously consist of a centrifuge pump, which recirculates the fluid inside the hydraulic circuit 10. In greater detail, the fluid inside the hydraulic circuit 10 will advantageously be clean water originating from the water mains. For this purpose, the hydraulic circuit provides a connection point 15 to the mains.

In a preferred embodiment of the present invention, the accumulation means 13 of the fluid which crosses the hydraulic circuit 10 consist of a substantially cylindrical pipe having a small diameter with respect to the length, having an overall volume equivalent to the volume of water used in all wash cycles.

Downstream of said accumulation means 13, first on-off means 14 of the fluid are further provided, consisting of a valve and of an outflow line which branches off from the hydraulic circuit to the rinsing means of the machine.

In the embodiment of the fume abatement apparatus considered herein in association with a washing machine without a cooling circuit, said rinsing means comprise, in addition to the rinsing rods and to the nozzles 102 as known from the state of the art, a "boiler" 19 for heating the rinse water originating from the hydraulic circuit 10, and the flow to said boiler is regulated by second on-off means 18, advantageously consisting of a second valve.

The operation of the apparatus for abatement of vapors according to the present invention is as follows.

As described above, during the washing step water is employed, generally with detergent additives, which is contained in a washing bath arranged below the washing chamber 101.

In this step, the hydraulic circuit 10 is therefore filled and pressurized with clean water originating from the mains, the first valve 14 is open and the second outflow valve 18 is closed. The fluid, substantially consisting of clean mains water, is then recirculated by the centrifugal pump 11 for moving the fluid in the circuit comprising the heat exchange means 12, the accumulation means 13 and the recirculation pump 11.

Due to the temperature difference between the mains water, generally ranging between about 5° C. and 24° C., and the temperature of the vapors inside the washing chamber 101, the rinse water progressively heats also during the washing step, in which the axial fan 105 operates at a minimum speed, while the hot vapors condense. During washing, the extraction fan 105 operates at a minimum speed, in order not to subtract heat useful to the washing step, and the condensing of the vapors occurs in any event to avoid the washing chamber from being saturated with fumes.

When the washing machine must perform the rinsing step, the first normally open valve 14 is closed, the second valve 18 arranged on the outflow line 17 is opened.

Thereby, the pressure of the mains water "pushes" the water inside the circuit and, finding the first valve 14 closed, the fluid crosses the recirculation pump 11 and the heat exchange means 12, and pushes the water accumulated in the accumulation basin 13 to the outflow line 17. The water already contained in boiler 19 is pushed towards the rinsing rods and the nozzles 102, and the same amount of water sprayed onto the load during the rinsing step is reintroduced into boiler 19.

The water which reaches the boiler 19 will be already pre-heated because, by suitably dimensioning the accumulation means 13, as mentioned, the inside of the accumulation means 13 will contain the same amount of water used in the rinsing step and which is now to be restored inside boiler 19, and as mentioned, the water contained in the accumulation means 13 is preheated as it is continuously recirculated inside the hydraulic circuit 10 according to the present invention.

Under normal operating conditions, the hydraulic circuit 10 is maintained pressurized by the water supply mains made available by the user.

The vapor extraction fan 105 is electrically driven by an electronic board which allows different speeds to be programmed for the various cycle steps by means of the controller and the operator interface generally installed on the electric panel.

At the startup of a wash cycle, the start of the main pump generates an overpressure in the washing chamber which is as high as the temperature difference between the washing bath and the steel walls of the chamber.

This overpressure is to be balanced by a negative pressure by using the extraction fan at maximum speed for a short period. The hot vapors extracted pass through the air/water exchanger, where the water side consists of exchange means 12 of the hydraulic circuit where the water circulates at a lower temperature, and are condensed thus avoiding saturating the working environment with vapors which would raise the humidity level to unacceptable values.

The other step in which the extraction fan 105 is supplied at its maximum speed is the fume extraction step at the end of the wash cycle before opening the washing chamber door. This is the greatest energy recovery step, as it is the longest and also that with the vapors contained in the chamber at the highest temperature, because it occurs after the rinsing step which is generally performed with water at 82° C.

The duration of the vapor extraction step is programmed through the controller for the automatic management of all the wash cycle steps and must ensure that when the access door to the chamber is opened, the operator is not hit by the escaping vapors. The extraction step may be programmed with different speeds, which are calibrated so as to ensure that the air flow rate at the beginning of the vapor extraction is compatible with the dimensioning of the air/water exchanger to ensure the effectiveness of the vapor condensing.

The circulation pump and the extraction fan are also activated during the other wash cycle steps, but the extraction fan is controlled at a minimum speed, for the sole purpose of avoiding the chamber from being saturated with vapors. In addition to not being required, a too vigorous extraction in these steps could also lead to a waste of energy subtracted from the washing bath.

During the vapor extraction steps at maximum speed of the fan 105, the heat exchange is obtained with the water which causes the gradual heating of the water accumulated in the accumulation basin 13, thus ensuring an available volume of pre-heated water.

Figure 3:
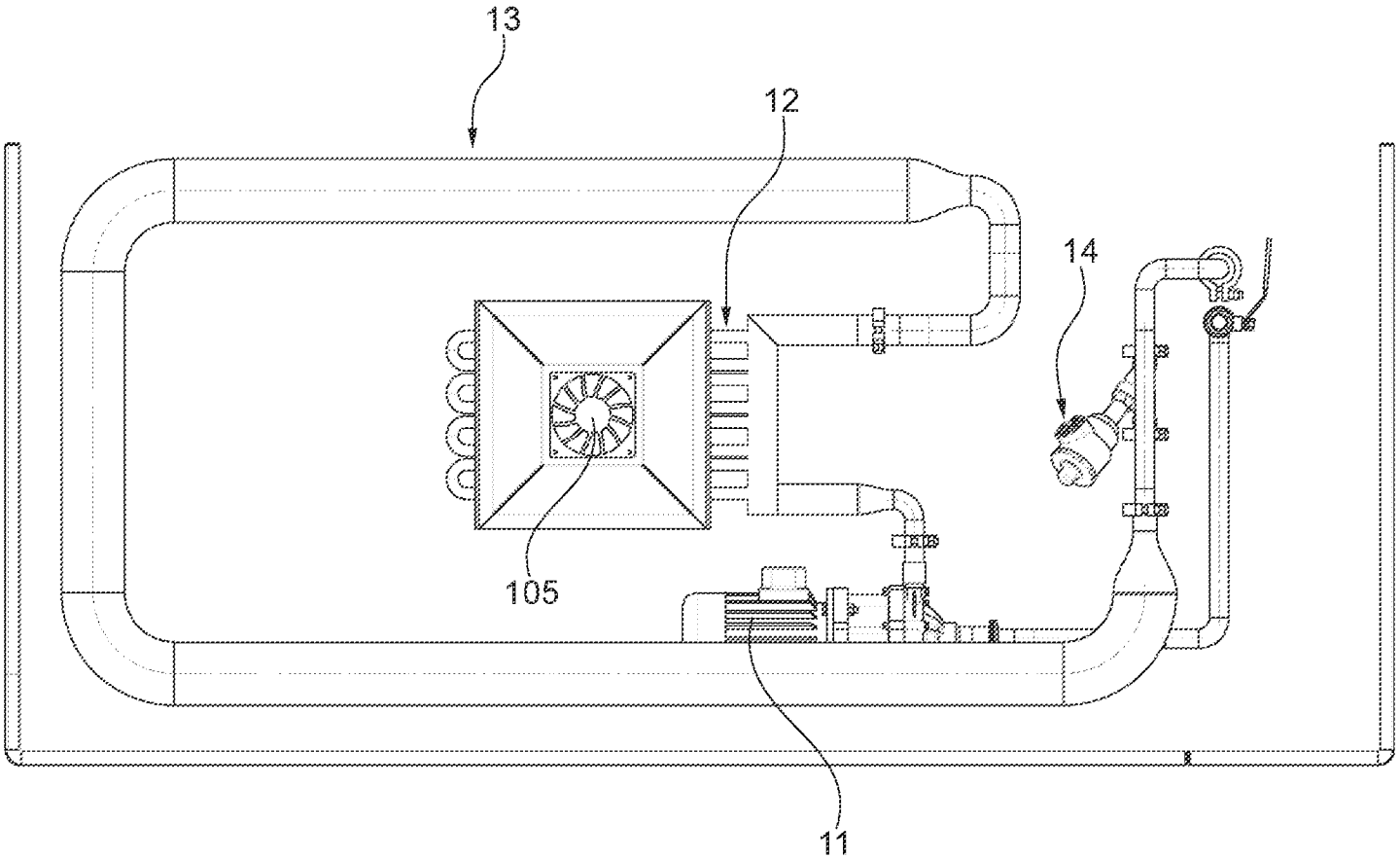
FIG. 3 shows a construction drawing of the apparatus for abatement of vapors associated with the washing machine of the first type, according to the diagram in FIG. 1.
Figure 4:
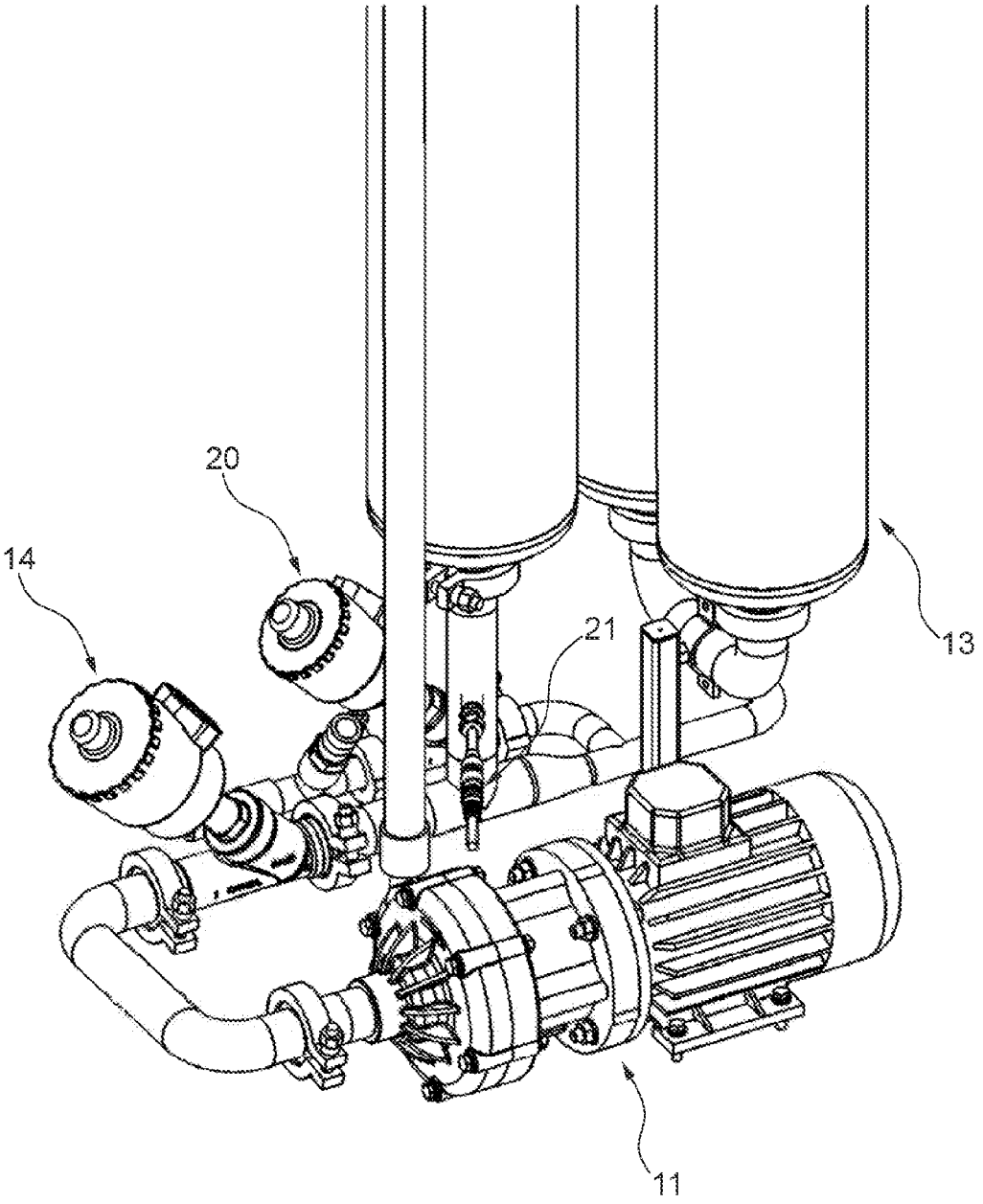
FIGS. 4, 5, 6 and 7 show construction drawings of the apparatus for abatement of vapors associated with the washing machine of the second type, according to the diagram in FIG. 2.
Figure 5:
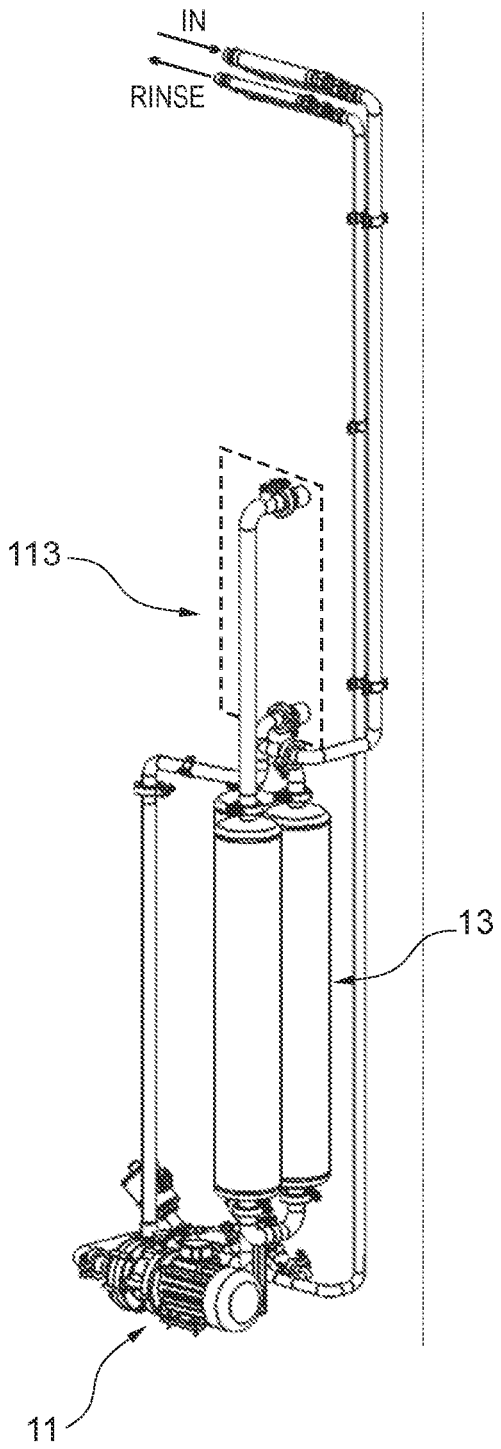
Figure 6:
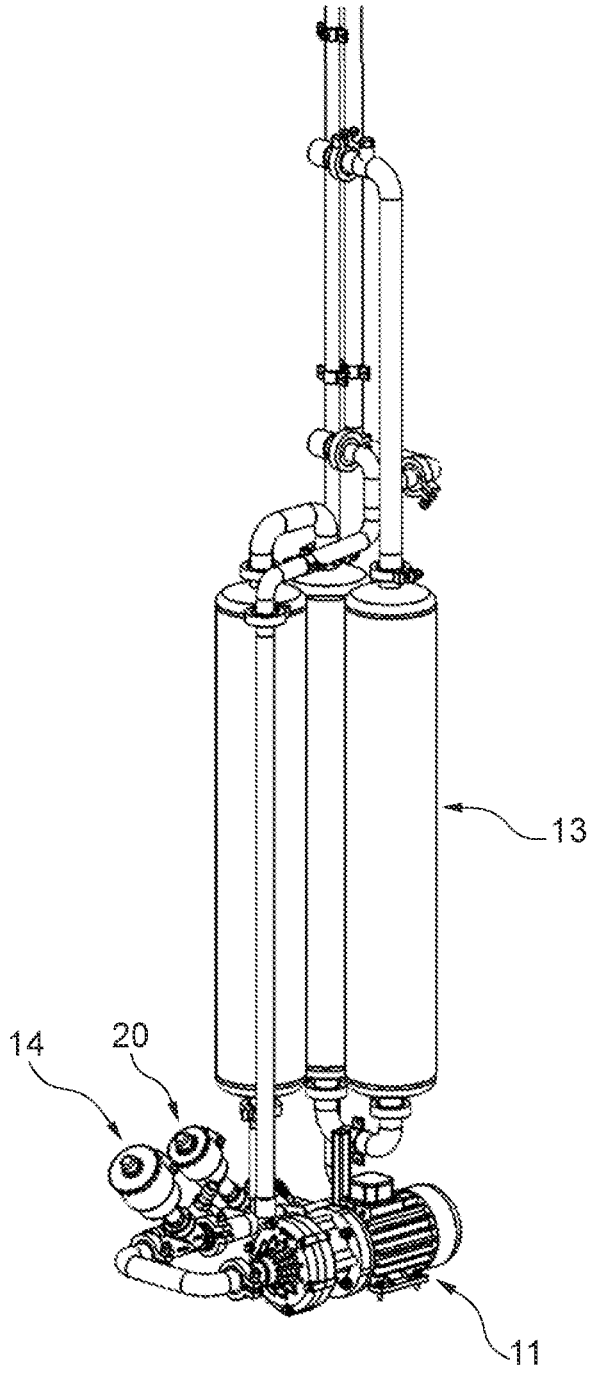
Figure 7:
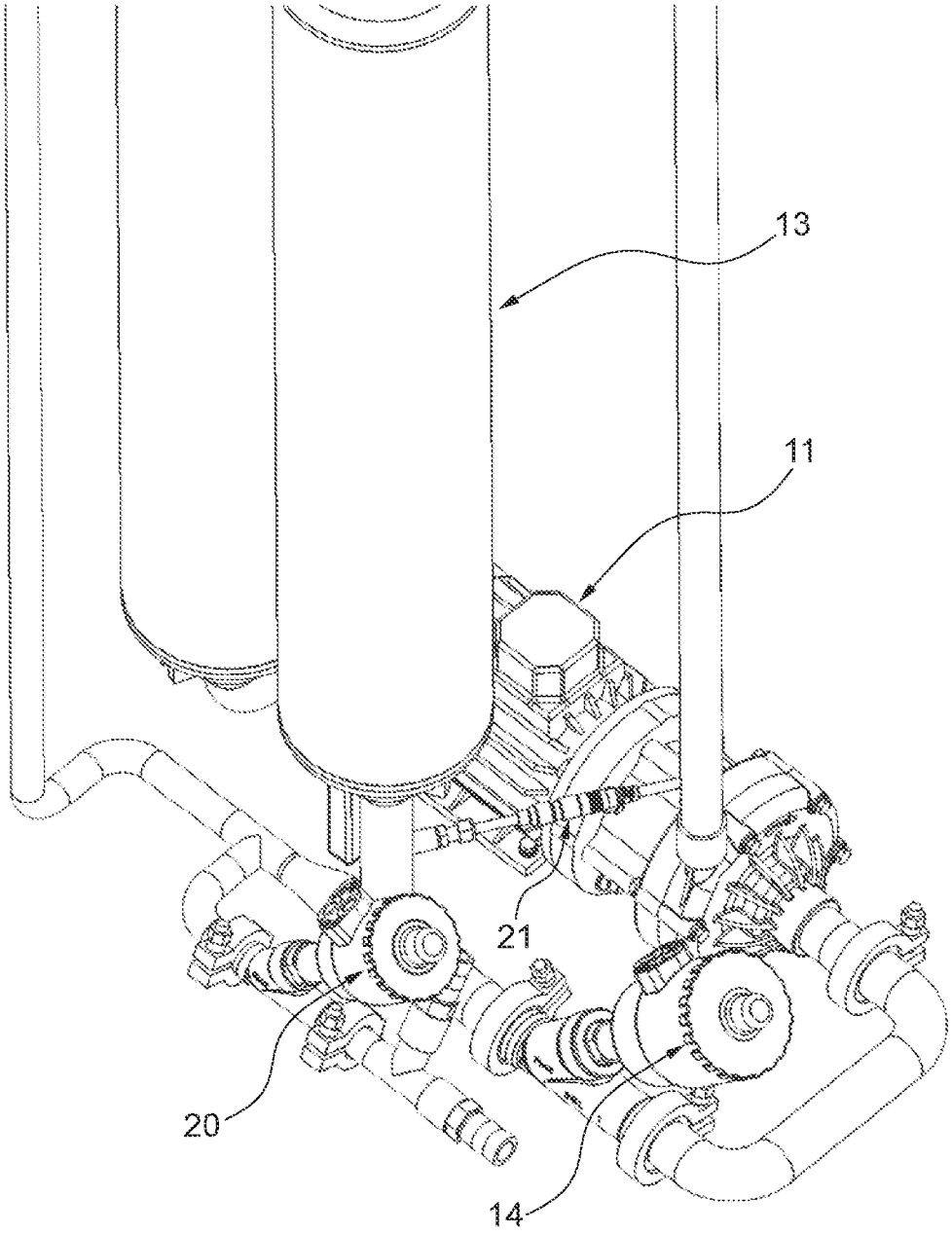

FIG. 3 shows a construction drawing of the apparatus for abatement of vapors according to the present invention.

The drawing shows how the apparatus according to the present invention comprises accumulation means 13 which are shaped like a cylindrical pipe having small diameter with respect to the length, and volume proportionate to the volume of water required in the rinsing step.

The apparatus for abatement of vapors according to the present invention is directly arranged on the "roof" of the washing machine, as the axial fan 105 and the air/water exchanger, to which the heat exchange means 12 belong, are directly arranged on the roof of the machine. Therefore, the apparatus for abatement of vapors according to the present invention in accordance with this first embodiment allows increased energy savings to be obtained because it allows the water used in the rinsing operations to be pre-heated by using the heat energy of the vapors which are generated in the washing chamber, while obtaining the technical result of abating said vapors.

Figure 2:
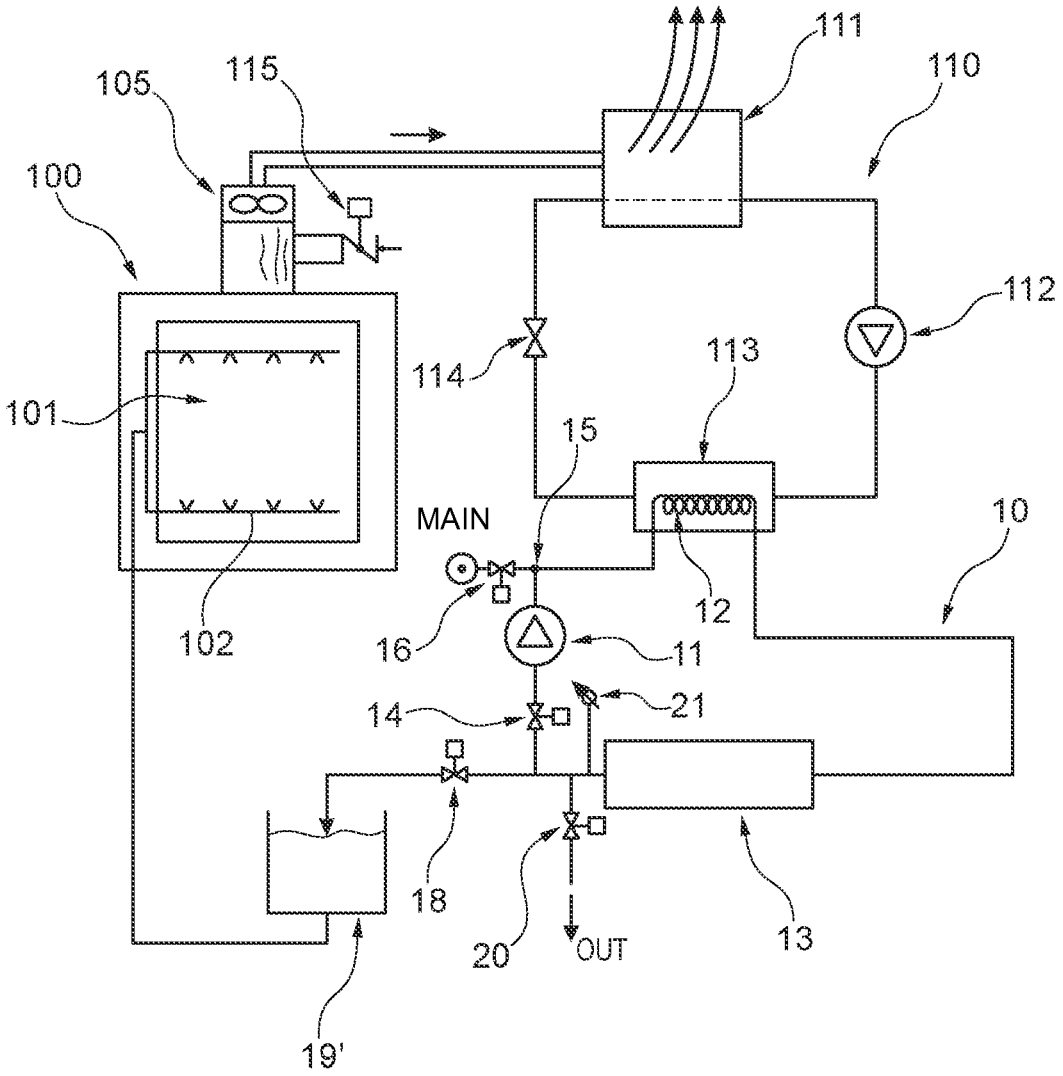
FIG. 2 shows a diagram of the apparatus for abatement of vapors according to the present invention, applied to a second type of washing machine.

With particular reference to FIG. 2, the apparatus for abatement of vapors according to the present invention may be installed on a washing machine of the type comprising a circuit in which there is a second working fluid. In particular, said second working fluid may advantageously be a cooling fluid of a cooling unit used for condensing the vapors.

As known from the above-described state of the art, washing machines of larger dimensions generate larger quantities of hot vapors which they are not able to abate by using an air/water exchanger, as considered above.

In this type of machines, the fume extraction means 105 extract the vapors from the washing chamber and convey them to the evaporator of a cooling circuit 110 in which a cooling liquid recirculates.

As known, a cooling circuit comprises at least one evaporator 111, a compressor 112, a condenser 113 and a lamination valve 114.

The hot fumes extracted by the axial fan 105 are conveyed onto the evaporator 111 of the cooling circuit. Upon passing in the compressor and in the lamination valve, the cooling fluid in the vapor state subtracts energy from the hot fumes thus condensing them. The temperature and humidity values are simultaneously abated and the fumes are freed into the environment again by evaporator 111.

The cooling fluid in the gaseous state is conveyed, through compressor 112, to condenser 113 and, from there, to the lamination valve 114.

When the apparatus for abatement of vapors according to the present invention is associated with washing machines of this type, comprising a cooling circuit, the heat exchange means 12 comprise the condenser 113 of said cooling circuit.

The operation of the apparatus for abatement of fumes remains unvaried with respect to that described above: the fluid inside the hydraulic circuit 10 is recirculated by the recirculation pump 11, the first valve 14 being normally open, and the second valve 18 arranged on the outflow line being closed.

When the cooling system is in operation, the cooling gas yields, in condenser 113, energy to the water which circulates in the hydraulic circuit 10 and, in particular, in the heat exchange means 12, and which is put into circulation between accumulation basin 13 and condenser 113 by means of the centrifuge pump 11.

Thereby, the water accumulated in basin 13 gradually increases its temperature during all the steps of a wash cycle. In these steps, the second automatic valve 18 is closed and the first automatic valve 14 is open.

The automatic valves are managed by the PLC which regulates the entire washing machine process.

In the step of restoring the volume of water used of the rinsing basin, the first normally open valve 14 closes, the second valve 18 opens and the circulation pump 11 stops.

Thereby, the cold water arriving from the distribution mains due to its pressure "pushes" the preheated water accumulated in basin 13 directly into the rinsing basin 19' thus restoring the working level with water having a higher energy content recovered in the condenser 113 of the cooling system.

Once the maximum level is restored in the rinsing basin, the second valve 18 closes again, the first valve 14 opens and pump 11 resumes its work of recirculating the water between the accumulation basin 13 and the condenser 113.

During the step of filling the rinsing basin 19', the hot water accumulated in basin 13 is replaced with mains water at a lower temperature thus ensuring the conditions for the proper operation of the cooling cycle, which cooling gas may thus be cooled in condenser 113, and accordingly the possibility to perform another wash cycle.

Advantageously, the accumulation basin 13 is just a simple vessel which in its simplest embodiment could be conceived as a cylindrical barrel, but it consists of a series of pipes of small diameter with respect to the length, the overall volume of which corresponds to the volume of water used in a normal wash cycle, and which is thus to be restored in the rinsing basin 19'.

By adopting long pipes of small diameter rather than arranging a basin of large diameter, the water mixing phenomenon is contained because the mains pressure creates a flow of liquid at a lower temperature which "pushes" the liquid at a higher temperature with a "piston" effect.

FIGS. 4, 5, 6 and 7 show a possible preferred embodiment of the apparatus for abatement of vapors according to the present invention applied hereinto a machine provided with a cooling circuit. The figures particularly show how the accumulation basin 13 consists of a plurality of cylindrical containers having small diameter with respect to the axial development. The figures show three containers, but obviously different solutions may be equally effective.

The mixing phenomenon would not provide the benefits expected both in terms of amount of heat recovered and of availability of cold water which must be made available for the cooling unit condenser to continue with proper operation, and the particular shape of the accumulation basins 13 serves to avoid the mixing phenomenon.

Since it is fundamental for the condenser of the cooling system 113 to always be crossed by water of the recirculation circuit 10 with a temperature value which must not to exceed that prescribed by the supplier of the cooling unit, in this case the system is accessorized with a further automatic drain valve 20 and a temperature probe 21 with safety functions.

The machine PLC controller opens the drain valve 20 if system malfunctions or abnormalities occur when the preset safety threshold is exceeded for the temperature of the water circulating between the accumulation basin 13 and the condenser 113 and detected by the temperature probe 21.

Thereby, the pressure of the mains will push the hot water to the sewage drain while replacing it with water at a lower temperature. Valve 20 will remain open until the temperature value descends below the preset safety value.

Another aspect which characterizes the above-described system is the aspiration conduit of the vapors, which are conveyed by means of fan 105 from the chamber of the washing machine to the evaporator 111 of the cooling unit.

The volume of air aspirated by the fan is not constant in all wash cycle steps because the chamber is always tightly sealed during the cycle with the exclusion of the final step of extracting the vapors, where the machine is not tightly sealed and the door is released. In order to ensure proper operation of the system, the cooling unit evaporator needs to be involved with a constant air flow, alternatively there would be a need to stop the cooling unit by turning off the compressor.

It is known that cooling units cannot be subjected to frequent startup and switching off operations of the compressor, which will result in a quick deterioration thereof. Therefore, compressor 112 is always kept in operation when the machine performs wash cycles and automatically switches off after a period of inactivity which can be set by means of the PLC.

In order to ensure the constant flow rate of the air aspirated in all steps of the cycle, the automatic on-off valve 115 of the air being aspirated from the outside is inserted on the aspiration conduit.

Valve 115 is opened in all the wash cycle steps in which the chamber is tightly sealed to aspirate the air from the environment, and is closed in the step of aspirating the vapors from the chamber at the end of the wash cycle.

Thereby, the cooling unit works with continuity and influences the working environment when not used to condense the vapors extracted from the washing chamber, thus optimizing the use thereof and the recovery of energy.

What is claimed is:

1. An apparatus for abatement of vapors for a washing machine comprising:

a washing chamber connected to a vapor aspiration device;

a rinsing basin;

a hydraulic circuit comprising a heat exchanger associated with the vapor aspiration device and configured to transfer heat from vapors received from the vapor aspiration device to a working fluid, wherein the heat exchanger comprises a condenser; and an outflow line adapted to discharge the working fluid from the hydraulic circuit to the rinsing basin, the hydraulic circuit being configured to recirculate the working fluid between the heat exchanger and the outflow line.

2. The apparatus according to claim 1, wherein the hydraulic circuit further comprises an accumulation basin for the working fluid.

3. The apparatus according to claim 2, wherein the hydraulic circuit is coupled to a water mains for introducing mains water as the working fluid.

4. The apparatus according to claim 2, further comprising a drain valve and a temperature probe arranged downstream of the accumulation basin.

5. The apparatus according to claim 2, further comprising a device for moving the working fluid through the hydraulic circuit.

6. The apparatus according to claim 5, wherein the device for moving the working fluid comprises a centrifugal pump.

7. The apparatus according to claim 6, wherein the accumulation basin comprises at least one cylindrical container configured to avoid mixing of the working fluid when an on-off valve is opened and the mains water enters into the hydraulic circuit and causes outflow of the working fluid to the outflow line.

8. The apparatus according to claim 7, wherein the accumulation basin comprises a plurality of cylindrical containers hydraulically connected to one another.

9. The apparatus according to claim 1, wherein the vapor aspiration device comprises an axial or centrifuge fan.

10. The apparatus according to claim 1, wherein the heat exchanger comprises an air-water exchanger.

11. The apparatus according to claim 10, wherein the air-water exchanger is positioned to be crossed by vapors processed by the vapor aspiration device from the washing chamber.

12. The apparatus according to claim 1, wherein the heat exchanger is adapted to exchange heat with a second working fluid.

13. The apparatus according to claim 12, wherein the second working fluid is a cooling fluid of a cooling circuit.

14. The apparatus according to claim 1 further comprising a device for moving the working fluid through the hydraulic circuit.

15. The apparatus according to claim 1, wherein the hydraulic circuit further comprises at least one connection point to the water mains for letting water from the mains into the circuit.

* * * * *